US006799499B2

(12) United States Patent
Seregelyi et al.

(10) Patent No.: US 6,799,499 B2
(45) Date of Patent: Oct. 5, 2004

(54) LANDMINE NEUTRALIZER USING A HIGH POWER MICROWAVE DEVICE

(75) Inventors: Joseph S. Seregelyi, Stittsville (CA); Denis M. Bergeron, Campbelltown (AU); Satish Kashyap, Kanata (CA)

(73) Assignee: Her Majesty the Queen in right of Canada, as represented by the Minister of National Defence, Ottawa, Ontario (CA)

( * ) Notice: Subject to any disclaimer, the term of this patent is extended or adjusted under 35 U.S.C. 154(b) by 0 days.

(21) Appl. No.: 10/424,156

(22) Filed: Apr. 28, 2003

(65) Prior Publication Data

US 2004/0007122 A1 Jan. 15, 2004

Related U.S. Application Data

(60) Provisional application No. 60/376,201, filed on Apr. 30, 2002.

(51) Int. Cl.[7] ..... B63G 7/06

(52) U.S. Cl. ..... 89/1.13; 102/402

(58) Field of Search ..... 89/1.13; 102/402, 102/403

(56) References Cited

U.S. PATENT DOCUMENTS

| | | | | | |
|---|---|---|---|---|---|
| 5,423,260 | A | * | 6/1995 | Goldberg et al. | 101/424.1 |
| 5,926,080 | A | * | 7/1999 | Palan et al. | 333/252 |
| 5,968,401 | A | * | 10/1999 | Roy | 219/690 |
| 6,343,534 | B1 | | 2/2002 | Khanna et al. | |
| 6,487,950 | B2 | | 12/2002 | Samland | |
| 2002/0108485 | A1 | * | 8/2002 | Samland | 89/1.13 |

FOREIGN PATENT DOCUMENTS

| | | | | |
|---|---|---|---|---|
| DE | 21 21 089 | * | 11/1972 | 89/1.13 |
| DE | 197 44 794 A1 | | 10/1998 | |
| GB | 2 184 068 A | * | 6/1987 | |

OTHER PUBLICATIONS

Author unknown; "Assembly and Test Results of a Focused Beam Parabolic Antenna"; IMT; Final Report (Phase II), Mar. 1998; 35 pages.

Seregelyi et al; "Neutralisation of Landmines Using a High–Power Microwave Applicator"; Defence Research Establishments Ottawa & Suffield—Technical Report DRES–TR–01–127; Aug. 10, 2001 ; 72 pages.

Chamma et al; "Numerical Modelling of the Microwave Coupling to Buried Targets"; Defence Research Establishment Ottawa; Technical Report DREO TR 2000–116; Dec. 13, 2000; 30 pages.

Author unknown; "Design of a High Power, Small Spot Size Microwave Antenna"; IMT Final Report; Executive Summary; Feb., 1997; 7 pages.

Seregelyi et al; "Neutralisation of Landmines Using a High–Power Microwave Applicator", Phase I; Defence Research Establishments Ottawa & Suffield—Technical Report DRES–TR–01–127; pp. 1–67; Aug. 10, 2001; 84 pages.

Hasue et al; "Initiation of Some Energetic Materials by Microwave Heating"; Propellants, Explosives, Pyrotechnics 15, 181–186, 1990.

(List continued on next page.)

*Primary Examiner*—Stephen M. Johnson
(74) *Attorney, Agent, or Firm*—Stites & Harbison, PLLC; Ross F. Hunt, Jr.

(57) ABSTRACT

An apparatus to neutralize landmines using high power microwaves has a blast hardened dish antenna mounted on a vehicle along with a microwave generator and power generator A waveguide from the microwave generator feeds microwaves to a feed horn for the antenna. Plugs that are transparent to microwaves are located in the waveguide to prevent the blast wave generated by a detonated landmine from propagating inside of the waveguide and damaging the microwave generator. Flexible sections in the waveguide dampen any shock wave produced by a detonated mine from traveling along the waveguide towards the microwave generator.

12 Claims, 6 Drawing Sheets

OTHER PUBLICATIONS

Gardner et al; The Feasibility of HPM for the Neutralisation of No–Metallic Mines (U); Defence Research Establishment Ottawa—Technical Memorandum # 95–01; Jan. 24, 1995; 8 pages.

Murray et al; "Microwave Resonant Absorption of Potential Exothermic Compounds"; Defence Technical Information Center, pp. 1–24; 1989.

Seregelyi et al; "Microwave Heating of Soil"; Defence Research Establishment Ottawa—Report No. 1331, pp. 1–35; Feb. 1998.

Kashyap et al; "EM Field Penetration into Metallic Land Mines"; Defence Research Establishment Ottawa; pp. 1–34; Jun. 1995.

Kashyap et al; "Electromagnetic Scattering by an Object Buried in Soil"; ANTEM'98 Symposium on Antenna Technology and Applied Electromagnetic; pp. 397–400; no date.

Seregelyi et al; "Neutralisation of Land Mines Using High–Power Microwaves"; AMEREM—Annapolis; Jun. 2–7, 2002; 23 pages.

Chamma et al; "Microwave Heating of Buried Targets by Non–Planar Electromagnetic Waves"; Antem 2000 Symposium on Antennas and Electromagnetics; Winnipeg; Aug. 2000; pp 171–175.

Chamma et al; "EM Scattering by Inhomogenous Structures in the Fresnel Region of Aperture Antennas: A Numerical Approach"; Proc. of Joint URSI–IEEE AP Symposium; Salt Lake City, Utah; Jul. 2000; pp 1328–1331.

Seregelyi; HPM/IR Detection of Land Mines: Measurement and Modeling of Surrogate Mines; EUROEM, 2000; May 2000.

* cited by examiner

LANDMINE NEUTRALIZER USING A HIGH POWER MICROWAVE DEVICE

This application is a continuation of provisional U.S. application 60/376,201, filed on Apr. 30/2002, and now abandoned.

FIELD OF THE INVENTION

The present invention relates, in general, to an apparatus to neutralize landmines and, in particular, to an apparatus to neutralize landmines with high power microwaves

BACKGROUND OF THE INVENTION

Canadian Forces soldiers deployed abroad during the early 1990's suffered a large number of landmine accidents, many involving vehicles that were struck by low metal content landmines buried in roads. Existing detection technology at that time, primarily based on metal detection, had failed to detect landmines which were located in the path of the vehicles.

A mine neutralisation study in 1995 assumed that neutralisation activities would follow a robot detection vehicle. That study considered that, for the short term, a mini-flail could be used in concert with an array of shaped charges to neutralize detected landmines. It recommended, however, that the potential of using High Power Microwaves (HPM) to neutralize landmines be investigated.

W. J. Graham, in an internal research report looked into the feasibility of a focussed microwave array for detecting and neutralising buried landmines. A focussed array consists of a series of flat elements with precision-machined slots from which microwave radiation is emitted. The neutralisation concept was based on the ability of the system to concentrate sufficient microwave energy on a small patch of ground approximately 25–30 $cm^2$ in size to reach a field intensity over $100W/cm^2$. Neutralisation of the landmine was intended to be obtained through melting the plastic components of the pressure plate in order to disable the functioning mechanism rather than the initiation of a high order detonation.

An article in The Mail on Sunday on Jun. 15, 1997 entitled "Will a British microwave stop the worldwide horror of the landmine?" indicated that if they could design a radar antenna which could concentrate microwaves into a tight beam there would be a reasonable chance of setting off a spark that could detonate a landmine from a distance.

An article "Electromagnetic Scattering by an Object Buried in Soil" by S. Kashyap et al appeared in the ANTEM '98 Symposium on Antenna Technology and Applied Electromagnetics examined the scattering of electromagnetic wave by an object buried in the soil and their effects.

A German Patent DE19744794 by Samland Thomas which was published on Nov. 15, 1998 is directed to a mine clearance method using a high power focussed microwave beam by detection of reflected radiation in the microwave or IR range. Another U.S. Pat. No. 6,343,534 by S. Khanna et al also teaches the detection of landmines using high power microwaves. In this US Patent, a thermal signature of the soil surface is obtained in real time as the soil is being irradiated forming an interference pattern at the soil surface and also further thermal signatures are obtained after irradiation resulting from thermal conduction from a mine heated by the microwaves.

SUMMARY OF THE INVENTION

It is an object of the present invention to provide an apparatus to neutralize landmines using high power microwaves and to provide a design that prevents damage to the microwave generator when a landmine is detonated by the apparatus.

An apparatus to neutralize landmines using high power microwaves, according to one embodiment of the present invention, comprises an antenna mounted on a vehicle at an angle to the vertical such that a microwave beam is directed to a surface of soil near the vehicle when a microwave generator is energized, the microwave generator and a power source being mounted on said vehicle with a waveguide being connected between the microwave generator and a feed horn for the antenna, at least one plug that is transparent to said microwaves being positioned in said waveguide to prevent any blast wave produced by a detonated mine from propagating inside of said waveguide towards the microwave generator.

BRIEF DESCRIPTION OF THE DRAWINGS

The invention will now be described in more detail with reference to the accompanying drawings, in which.

DESCRIPTION OF THE PREFERRED EMBODIMENTS

Canadian Forces soldiers deployed abroad during the early 1990's suffered a large number of landmine accidents, many involving vehicles that were struck by low metal content landmines buried in roads. Existing detection technology at that time, primarily based on metal detection, had failed to detect landmines which were located in the path of the vehicles.

A mine neutralisation study in 1995 assumed that neutralisation activities would follow a robot detection vehicle. One type of robot detection vehicle is described by John E. McFee et al in U.S. Pat. No. 6,026,135 for a Multisensor Vehicle-Mounted Mine Detector. That study considered that, for the short term, a mini-flail could be used in concert with an array of shaped charges to neutralize detected landmines. It recommended, however, that the potential of using High Power Microwaves (HPM) to neutralize landmines be investigated.

Figure 1:
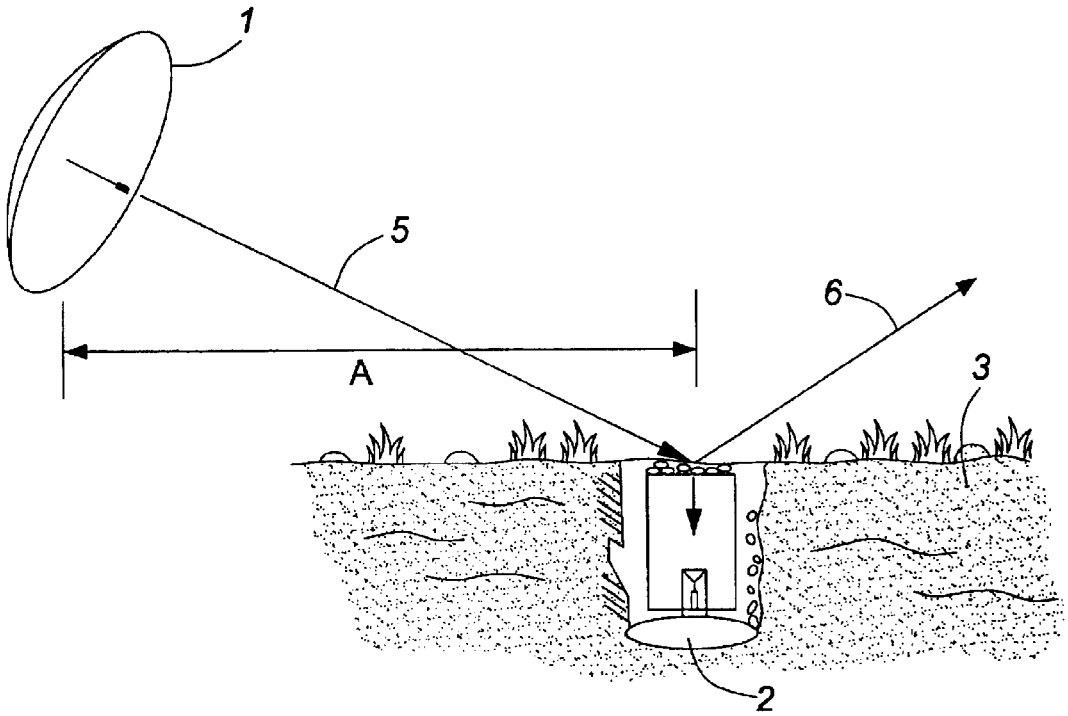
FIG. 1 schematically illustrates a landmine neutralisation system using high power microwaves according to the present invention.

The basic concept of using HPM to neutralize landmines according to the present invention is illustrated in FIG. 1. In the FIG. 1 concept a microwave antenna 1 mounted on an armoured vehicle (not shown) would be placed 5 to 7 metres (distance A) away from a target landmine 2 buried in soil 3.

The antenna 1 focuses a microwave beam 5 on the soil 3 above the mine to illuminate that area with 10's of kW of power causing the soil 3 to heat up to the point of initiating combustion within the landmine 2. A portion of the beam 5 would be reflected as indicated by arrow 6.

A series of trials were carried out to establish that HPM could sufficiently heat a soil medium by measuring the heating rates of soil exposed to microwave power. The heating rate in these trials depends on the amount of power being 'pumped' into the soil. The HPM effectively produces bulk (volumetric) heating of the soil but beam dispersion and losses in the medium were found to result in greater heating near the surface. The soil Moisture content effectively determines the absorption properties of the soil. The microwave energy can penetrate metres below the surface with very dry soil but, under normal moisture conditions, penetration depths of 5–10 cm are more typical. It should be noted that this is an instantaneous effect, unlike conventional surface heating methods. The temperature of the soil increases rapidly until it reaches a plateau of 100° C. where moisture in the soil is vaporised. Once vaporization has occurred, the temperature continues to rise and the microwave penetration depth increases. These trials concluded that thermal heating of a landmine by HPM would be possible since it was demonstrated that significant heating rates could be imparted to soil using HPM.

Landmine surrogates were fabricated from various plastics for testing. These were simple discs with dimensions similar to a typical anti-personnel landmine. Some discs were modified to emulate the gross configuration of the PMA-2 and PMA-3 landmines by adding a Bakelite disc or a rubber cap on the plastic disks. Although the Bakelite and rubber (both of which are strong microwave absorbers) influenced the top of the mine, the centre of the mine was not strongly influenced. Tests on the plastic surrogate landmines showed they could be heated by microwaves well above their deformation temperature within a few minutes despite the fact that the plastics used are poor microwave absorbers. Many discs were in a gelatinous state when removed from the soil and could easily be crushed with a gloved hand. This indicated that significant deformation of the case of a plastic landmine could be expected and particularly if dissimilar materials with different absorption and thermal expansion rates were present.

Tests were also performed on individual fuses and mine bodies in order to isolate the effects of microwaves on those components. Test on fuses in isolation demonstrated the fuse construction and orientation had a strong effect on the results. There was a very strong polarization dependence with respect to the orientation of the incident electric field for the UPMAH-1 fuse. When that type of fuse had maximum coupling to the electric field, it was initiated in 19 seconds. When the coupling was 90° to this, i.e. minimum electric field, this type of fuse did not initiate over the course of 6 minutes of microwave exposure. Initiation of a UPMAH-2 fuse was achieved in 1.15 minutes and that of a UPMAH-3 fuse in a little over 5 minutes.

Figure 2A:
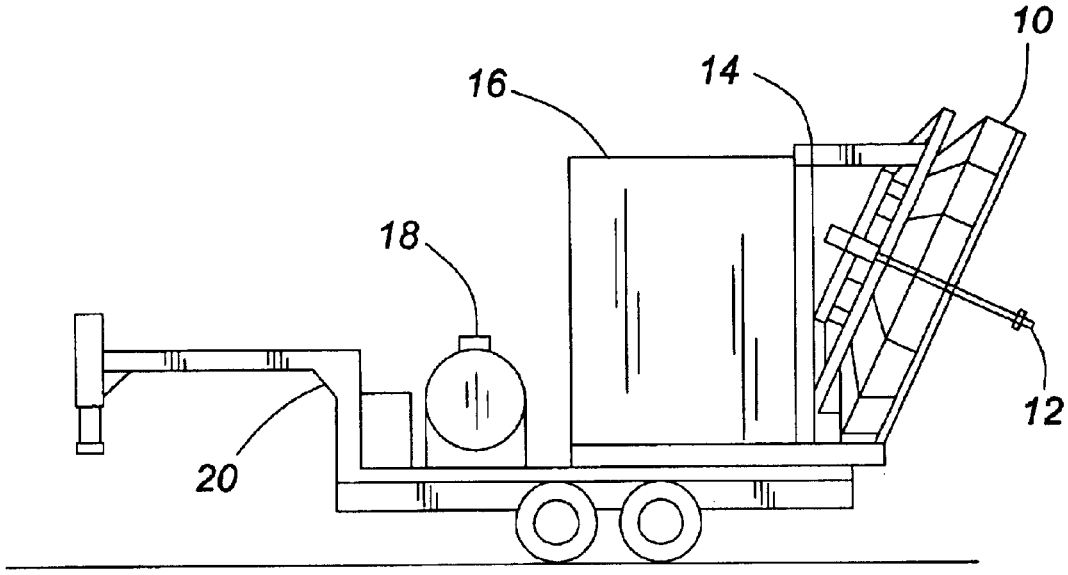
FIG. 2A is a side view of an apparatus according to one embodiment of the present invention and FIG. 2B is a front view of that apparatus.
Figure 2B:
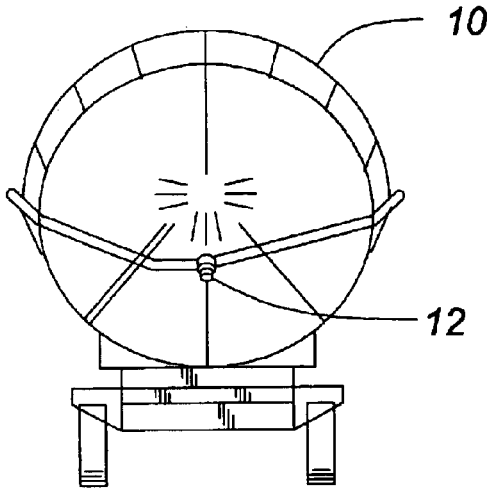

Three minimum-metal landmines PMA-1, PMA-2 and PMA-3 were ones initially selected for feasibility trials at DRDC Suffield. This selection offered targets of very different shapes and configurations. The apparatus used for these trials is illustrated in the side view of FIG. 2A and front view of FIG. 2B In FIGS. 2A and B, the apparatus has a blast hardened microwave dish antenna 10 with a waveguide feed 12, the dish 10 being mounted on a trailer 20 and positioned at an angle to the vertical by an I-beam frame 14. This orientation focuses a microwave beam towards the soil's surface. A magnetron and power supply in enclosure 16 feed microwave energy to the waveguide's 12 feed horn to irradiate the surface where a mine is located. A cooling water reservoir 18 for the magnetron is also located on trailer 20.

A second antenna design was investigated which was a phased-array antenna. A comparison of numerical simulations performed on the two antenna designs revealed that they should have comparable electrical properties. The dish antenna would be simple to build but was susceptible to blast loading because of its large surface area and parabolic shape. The flat phase-array antenna, on the other hand, could be made very mechanically robust but it would have a complicated feed array and would require precision machining of slots over the entire array only the dish antenna was constructed for the trials at DRDC Suffield since the power densities produced by both antenna are similar.

A dish antenna and magnetron are not designed to operate in a shock and blast environment. This is particularly true for the dish antenna because of the enormous surface area exposed to a blast wave when a landmine is detonated. The parabolic shape of the dish, which is required to focus the microwave energy, also focuses any blast wave from a detonated mine into the feed horn for the antenna and the closed geometric path of the waveguide is conductive to the propagation of that blast wave. The strength of that blast wave, as a result, would not decay to safe levels over the distance separating the landmine and the resonance cavity of the magnetron. A magnetron contains a heated filament used to inject electrons into its resonant cavity which, in turn, generates microwaves. The filament is thin, brittle and operating at a high temperature and, as such, is susceptible to damage by vibration. This vulnerability increases as the filament ages and becomes more brittle.

Shock mounting the magnetron on the trailer is a primary means of protecting the magnetron. To avoid the transmission of a shock through the trailer to the magnetron, it was mounted in a shock-isolated box in enclosure 16 on the trailer 20 shown in FIG. 2A. In addition, both the magnetron and its power supply were mounted on shock-absorbing pads.

Figure 3A:
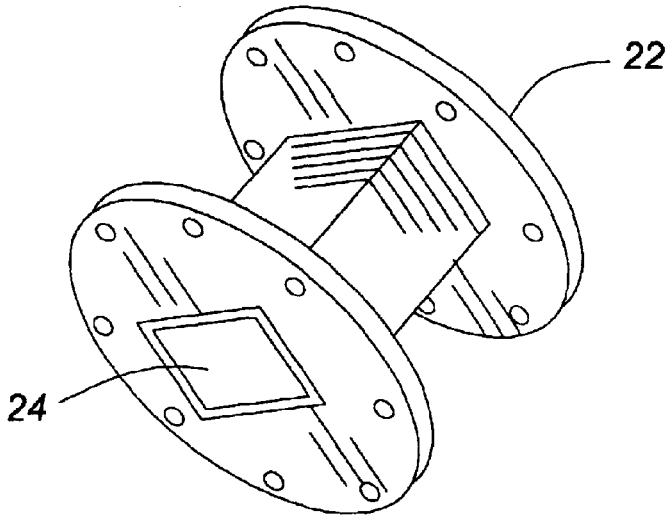
FIG. 3A is a perspective view of a section of a waveguide according to an embodiment of the present invention with a plug transparent to microwaves inserted in the waveguide to stop blast wave propagation in the waveguide.
Figure 3B:
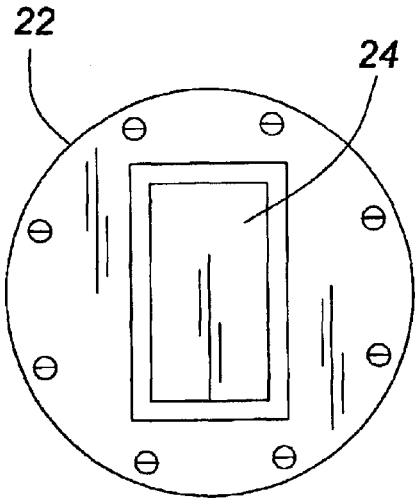
FIG. 3B is a front view of the waveguide section shown in FIGS. 3A and 3C is a cross-sectional view of that section.
Figure 3C:
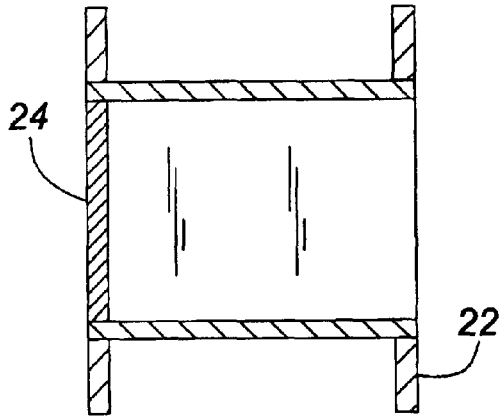
Figure 4:
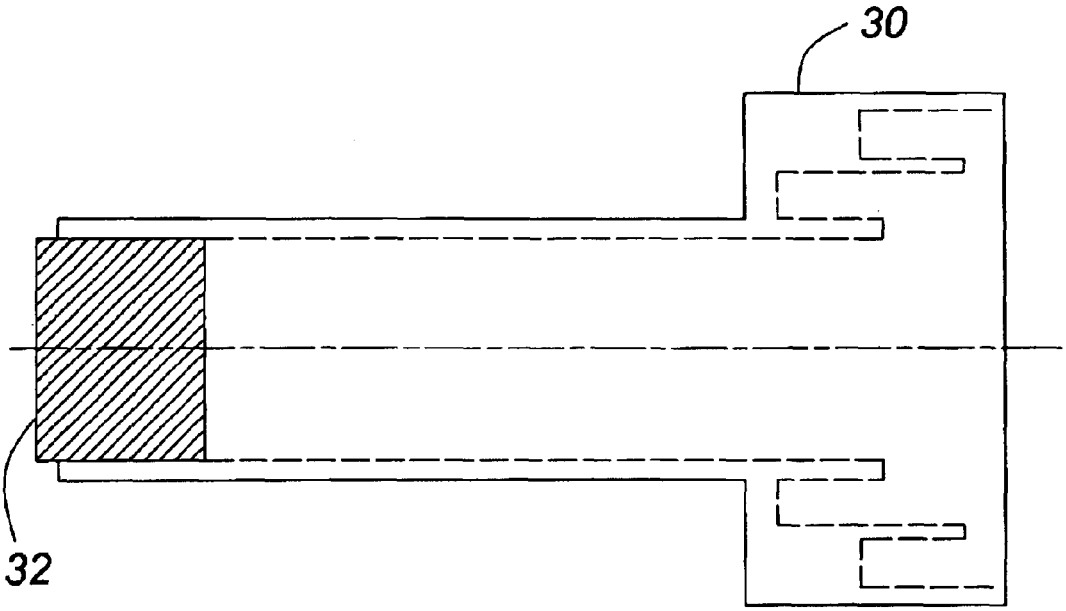
FIG. 4 is a cross-sectional view of a section of the feed horn according to an embodiment of the invention with a plug transparent to microwaves inserted to stop blast wave propagation in the waveguide towards a magnetron microwave generator.

A Teflon™ plug was incorporated into the waveguide to protect the magnetron from the blast wave that could, otherwise, propagate inside the waveguide sections. Redundant plugs were installed at two locations in the waveguide, one at the feed horn and a second near the waveguide elbow. The second plug 24 is illustrated in the waveguide section 22 shown in FIGS. 3A, 3B and 3C, plug 24 being press fit in waveguide section 22. The plug in the waveguide feed horn 30 shown in FIG. 4 is identified by the number 32. The dimensions and material properties of the plugs were chosen to make it transparent to the microwave energy propagating in the waveguide while preventing the blast wave from propagating within the waveguide. Types of plastic material other than Teflon™ could be used. One feature of the plug nearest the feed horn was that it is composed of several 25 mm thick pieces. This makes it possible to recycle the plug assembly after a blast by replacing one section which could be damaged. This is necessary since the presence of carbon contaminants from the blast on the surface of that section could cause arcing and a heat build-up that would result in power reflections and eventually shut down the system when the magnetron is energized.

A mechanical jolt caused by a blast could also propagate through the waveguide walls to the magnetron housing. To minimize that possibility, several flexible sections of waveguide were incorporated into the feed from the magnetron. One was placed at the entrance to the magnetron and a further two segments after a 90° elbow. Not only did those two segments dampen any mechanical vibrations, they also greatly simplified the assembly of the structure by allowing for compensation of small angular mismatches.

The initial feed assembly was fabricated in WR284 dimensioned waveguide since a supply of that material was readily available. It was found, however, that the losses in the flexible sections of that waveguide format were too great. Redesigning using the larger dimensioned WR340 waveguide eliminated that problem.

A small plug was placed in the antenna feed to act as a waveguide vent. The plug was composed of a 3.75 cm diameter insert machined to be a snug, but removable, fit in a hole in the back of the feed. The insert was flush with the interior of the feed and had negligible effect on the operation of the system. In the event of a significant pressure build-up occurring near the waveguide plug, it was intended that pressure from the vent would pop the small plug out and minimize damage. That plug, however, never disengaged and this indicated that there was no significant pressure build up in the feed and that the plug may not actually be necessary.

Figure 5:
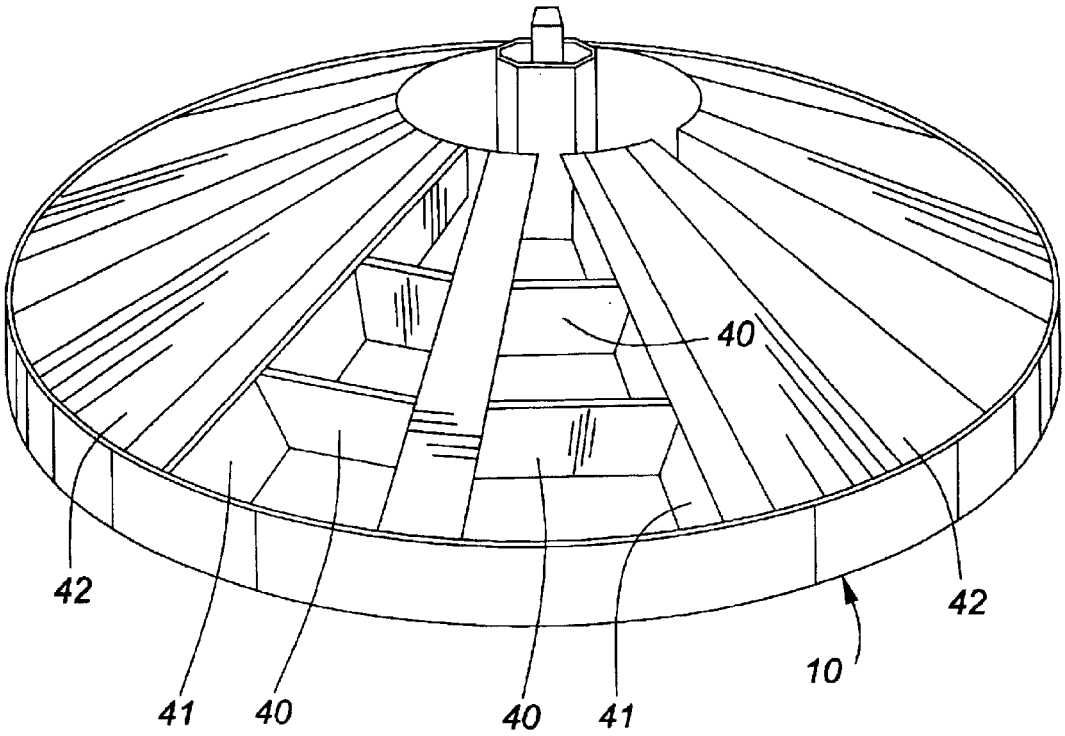
FIG. 5 is a perspective view of reinforcements and modification to a microwave dish to blast harden the dish.
Figure 6:
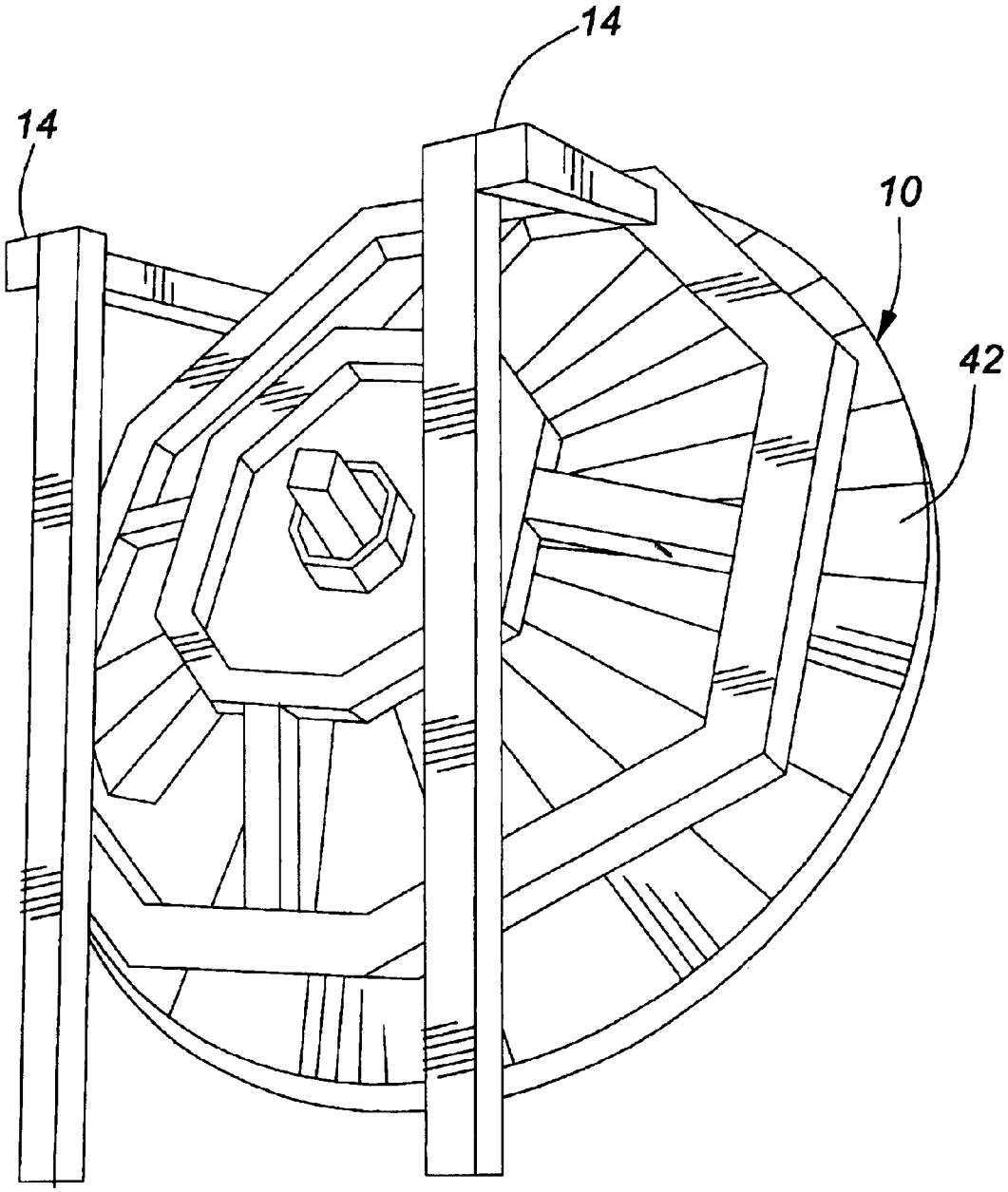
FIG. 6 is a perspective view of I-beam frame and the reinforced dish shown in FIG. 5, the I-beam frame supporting the overall structure.

To determine the requirements for blast hardening a parabolic dish antenna, a series of blast tests were performed on a commercial parabolic dish which was a surplus item and deemed expendable. Therefore, destructive testing could be performed. During testing, it was found that the commercial dish was not able to withstand some of the larger charges representing anti-tank mines. The dish 10 (see FIGS. 2A and B) used in trials on live landmines was reinforced extensively. Cross-braced ribs 40 (see FIG. 5) and 41 were added behind the dish 10 to help maintain the original shape of the dish. These were used to fabricate a ribbed network behind the dish for additional support and covered by outer support panels 42 to maintain the correct curvature. An I-beam frame 14 (see FIGS. 2A and 6) was added to support the overall structure on trailer 20 (see FIG. 2A) These modifications were, for the most part, sufficient to blast harden the dish. There was some deformation of the dish during the trials with live landmines although the overall shape of the dish remained intact. This deformation can be corrected by, preferably, using a much thicker dish or, alternatively, by back filling the area between the ribs with a support material.

Initial trials were performed with a relatively low-power 5 kW magnetron which was more than adequate for Phase 1 experiments because the exposed area under the waveguide was only about 100 $cm^2$ (with a very strong field gradient). However, in a general application, the exposed area would be around 25 by 50 cm, an area of approximately 1000 $cm^2$, and a much larger power source is required to maintain a comparable power density at the soil surface.

Magnetrons are the simplest and most robust technology on the microwave market. Kylstrons are available to very high powers but are expensive and would not be considered as practical under field conditions. Most other technologies, at present, are not suitable for field use. Phase-locked magnetrons may, however, be more practical in the near future.

Microwave heating of a landmine and surrounding soil is a volumetric heating process, i.e. a large volume of soil is heated simultaneously. This heating competes with normal cooling processes such as convection into the air and diffusion into the unheated surrounding soil. These cooling processes tend to act on a relatively slow time scale (a few minutes). Therefore, if the microwave heating can be applied quickly, the losses can be minimized and the efficiency of the process is increased. This is referred to as adiabatic heating.

The efficiency of the heating process and the time to neutralize a mine will decrease if a higher power microwave source is used. A higher power source is more expensive and is generally less robust. The most powerful magnetron source on the market at the time of this project was a 30 kW unit from Cober Electronics, model S30/10689. That model was chosen for the project as a compromise offering both a reasonable price and functionality.

Tests were carried out against several types of anti-personal (AP) and anti-tank (AT) landmines. The landmines listed in Table 1 were chosen because they were available to this project and represent a real threat found in the field. In addition, this selection of landmines offered several other advantages. These mines have different shapes and sizes, the fuse position varies from one type to the next and the fuses differ widely in design. These types offered a good cross-section of targets and all are minimum metal landmines that minimize the probability of detection by standard mine detectors.

TABLE 1

| Mine Type | Shape | Dimensions (mm) | Height (mm) | Explosive | Explosive Mass |
|---|---|---|---|---|---|
| PMA-1 | rectangular | 140 × 70 | 30 | Trotil | 200 gm |
| PMA-2 | circular | 68 (diam.) | 61 | Trotil/ Hexogen 70/30 | 100 gm |
| PMA-3 | circular | 111 (diam.) | 40 | TNT | 35 gm |
| M-14 | circular | 56 (diam.) | 46 | Tetryl | 35 gm |
| VS mrk II | circular | 90 (diam.) | 32 | RDX | 33 gm |
| PMN-2 | circular | 125 (diam.) | 54 | TNT | 115 gm |
| PPMINA1 | rectangular | 92 × 72 | 47 | TNT | 93 gm |
| TMA-4 (partial) | circular (cut wedge) | 208 (diam.) | 65 | TNT | 1.378 kg (total ≈1.3 kg (explosive) |
| TMA-3 | circular (cut wedge) | 265 (diam.) | 80 | TNT | 2.137 kg (total) ≈1.9 kg (explosive) |

TABLE 1-continued

| Mine Type | Shape | Dimensions (mm) | Height (mm) | Explosive | Explosive Mass |
|---|---|---|---|---|---|
| TMA-3 | circular (cut wedge) | 265 (diam.) | 80 | TNT | 2.536 kg (total) ≈2.3 kg (explosive) |
| PT-MI-BA III (1s fuse delay | circular | 320 (diam.) | 112 | TNT | 6 kg (total) |

A first test was on one type of electric detonator (a long cylindrical metal tube) and it was ignited in 25 minutes when the detonator long axis and lead wires were laid perpendicular to the electric field. However, ignition took place in about 10 seconds when the long axis was rotated 90° placing the detonator and lead wires parallel to the field.

Fourteen landmines were exposed to HPM radiation (see Table 2) with all mines being successfully neutralized by deflagration or detonation. It should be noted that all the mines were neutralized in 5 to 16 minutes at the 26 kW magnetron power level (trials 9 and 12 listed in Table 2 were at a 15.2 kW power level). Table 2 lists the type of mine used in Trials 2 to 15, burial depth, power level of HPM, exposure time and results.

TABLE 2

| Trail | Mine Type | Burial Depth (cm) | Power Level (kW) | Exposure Time (min:sec) | Results | Comments |
|---|---|---|---|---|---|---|
| 2 | PMA-3 | ~0.3 | 25.6 | 6:47 | deflagrate | Rubber gasket not burnt |
| 3 | PMA-2 | ~0.3 | 25.6 | 7:56 | deflagrate | burial: star about 1 cm above soil |
| 4 | PMA-2 | ~0.3 | 25.5 | 7:04 | deflagrate | burial: star about 1 cm above soil |
| 5 | PMA-2 | ~0.3 | 25.4 | 5:33 | deflagrate | burial: star about 1 cm above soil increased moisture content in soil |
| 6 | M-14 | ~0.3 | 25.4 | 8 | detonate | Metal ring always removed from base of M-14's |
| 7 | VS Mk II | ~0.3 | 25.5 | 9:04 | detonate | |
| 8 | PMN-2 | ~0.3 | 25.5 | 9:28 | detonate | |
| 9 | M-14 | ~0.3 | 15.2 | 24:03 | detonate | Location of beam may have been out by 10 cm |
| 10 | PP-Mi-Na 1 | ~0.3 | 25.4 | 16:04 | deflagrate | Location of beam may have been out by 10 cm |
| 11 | PMA-1 | ~0.3 | 25.4 | 15 | detonate | Mine angled at 45°. Beam location may have been out by 10 cm. Magnetron not operational after run complete: fuse blown in high-voltage transformer. These fuses are under-rated for current draw in system and will require a re-design. This problem occurs again in Trial 19 and appears to happen after the trailer is jolted by a large blast. The vertically mounted fuse elements may be jarred. |
| 12 | M-14 | ~0.3 | 15.2 | 19:10 | detonate | |
| 13 | M-14 | ~0.3 | 25.6 | 10:01 | detonate | |
| 14 | VS Mk II | ~0.3 | 25.6 | 10:32 | detonate | |
| 15 | M-14 | ~0.3 | 20.0 | 11:27 | detonate | Cooling problem in magnetron after about 2 minutes of heating. |

TABLE 2-continued

| Trail | Mine Type | Burial Depth (cm) | Power Level (kW) | Exposure Time (min:sec) | Results | Comments |
|---|---|---|---|---|---|---|
| | | | | | | Flow rates adjusted and system back on line after about 15 minutes. |

Various modifications may be made to the described embodiment without departing from the spirit and scope of the invention as defined in the appended claims.

What is claimed is:

1. An apparatus to neutralize landmines using high power microwaves of at least 5 kW comprising an antenna mounted on a vehicle at an angle to the vertical such that a microwave beam is directed to a surface of soil near the vehicle when a microwave generator is energized, the microwave generator and a power source being mounted on said vehicle with a waveguide being connected between the microwave generator and a feed horn for the antenna, at least on plug that is transparent to said microwaves being positioned in said waveguide to prevent any blast wave produced by a detonated mine from propagating inside of said waveguide towards the microwave generator.

2. An apparatus to neutralize landmines using high power microwaves a defined in claim 1, wherein said antenna is a dish antenna.

3. An apparatus as defined in claim 2, wherein said waveguide has at least one flexible section to dampen any shock wave produced by a detonated mine from traveling along said waveguide.

4. An apparatus as defined in claim 3, wherein the dish antenna is blast hardened by adding cross-braced ribs forming a ribbed network behind the dish to support is parabolic shape.

5. An apparatus as defined in claim 2, wherein the dish antenna is blast hardened by adding cross-braced ribs forming a ribbed network behind the dish to support its parabolic shape.

6. An apparatus as defined in claim 4, wherein the magnetron is a 30 kW unit.

7. An apparatus as defined in claim 1, wherein the microwave generator is a magnetron.

8. An apparatus as defined in claim 1, wherein said at least one plug is located at an elbow in the waveguide.

9. An apparatus as defined in claim 8, wherein a further plug that is transparent to said microwaves is positioned in said feed horn.

10. An apparatus as defined in claim 9, wherein said waveguide has at least one flexible section to dampen any shock wave produced by a detonated mine from traveling along said waveguide.

11. An apparatus as defined in claim 9, wherein said antenna is a dish antenna and said further plug is composed of several sections arranged along separate portions of the feedhorn allowing an outer section facing said dish antenna to be easily replaced if said outer section is subjected to contaminants.

12. An apparatus as defined in claim 11, wherein the dish antenna is blast hardened by adding cross-braced ribs forming a ribbed network behind the dish to support its parabolic shape.

* * * * *